US009399841B2

(12) United States Patent
Yamada

(10) Patent No.: US 9,399,841 B2
(45) Date of Patent: Jul. 26, 2016

(54) METHOD FOR PRODUCING WATER-DISINTEGRABLE PAPER

(71) Applicant: Kikuo Yamada, Shinagawa-ku (JP)

(72) Inventor: Kikuo Yamada, Shinagawa-ku (JP)

( * ) Notice: Subject to any disclaimer, the term of this patent is extended or adjusted under 35 U.S.C. 154(b) by 0 days.

(21) Appl. No.: 14/398,214

(22) PCT Filed: May 1, 2013

(86) PCT No.: PCT/JP2013/002911

§ 371 (c)(1),
(2) Date: Oct. 31, 2014

(87) PCT Pub. No.: WO2013/164913

PCT Pub. Date: Nov. 7, 2013

(65) Prior Publication Data

US 2015/0090414 A1 Apr. 2, 2015

(30) Foreign Application Priority Data

May 2, 2012 (JP) ..... 2012-105118
Oct. 5, 2012 (JP) ..... 2012-223022

(51) Int. Cl.
*B31F 1/07* (2006.01)
*D21H 27/00* (2006.01)
(Continued)

(52) U.S. Cl.
CPC *D21H 27/02* (2013.01); *B31F 1/07* (2013.01); *D21H 17/25* (2013.01); *D21H 21/20* (2013.01); *D21H 27/002* (2013.01); *B31F 2201/0743* (2013.01)

(58) Field of Classification Search
CPC . B31F 1/07; B31F 2201/0743; D21H 27/002; D21H 27/02; D21H 17/25; D21H 25/04; Y10T 156/1023; Y10T 428/24479; A47K 10/16
USPC ..... 162/109, 117, 158, 178, 177; 156/209, 156/219; 264/284
See application file for complete search history.

(56) References Cited

U.S. PATENT DOCUMENTS 1,540,268 A * 6/1925 Lorenz ..... 15/104.93
3,846,158 A * 11/1974 Vasilyadis ..... 428/211.1
(Continued)

FOREIGN PATENT DOCUMENTS

EP 421163 A2 * 4/1991
JP S50-000114 1/1975
(Continued)

OTHER PUBLICATIONS

International Search Report issued Aug. 6, 2013 in PCT/JP13/002911 Filed May 1, 2013.

*Primary Examiner* — Jose Fortuna
(74) *Attorney, Agent, or Firm* — Oblon, McClelland, Maier & Neustadt, L.L.P.

(57) ABSTRACT

A method of producing water-disintegrable paper, including: using a base-paper supplied with no water to emboss the base-paper sheet in a non-wet state to form a bulking unit, made up of a plurality of uneven elements, on the base-paper sheet; supplying the water-soluble binder to the base-paper sheet from outside of a face of the base-paper sheet after the embossing process to impregnate the water-soluble binder into the base-paper sheet; drying the base-paper sheet after the binder impregnation process; folding the base-paper sheet after the drying process; and supplying an aqueous chemical and/or a crosslinker to the base-paper sheet before or after the folding process to impregnate the aqueous chemical into the base-paper sheet.

4 Claims, 2 Drawing Sheets

(51) Int. Cl.

| | |
|---|---|
| ***D21H 27/02*** | (2006.01) |
| ***D21H 17/25*** | (2006.01) |
| ***D21H 21/20*** | (2006.01) |

(56) References Cited

U.S. PATENT DOCUMENTS

| | | | | |
|---|---|---|---|---|
| 3,966,519 | A * | 6/1976 | Mitchell et al. | 156/73.1 |
| 4,096,311 | A * | 6/1978 | Pietreniak | 442/59 |
| 4,537,807 | A * | 8/1985 | Chan et al. | 428/74 |
| 4,741,944 | A * | 5/1988 | Jackson et al. | 428/152 |
| 5,264,269 | A * | 11/1993 | Kakiuchi et al. | 428/156 |
| 5,281,306 | A * | 1/1994 | Kakiuchi et al. | 162/158 |
| 5,716,703 | A | 2/1998 | Payne | |
| 5,840,787 | A | 11/1998 | West et al. | |
| 5,849,153 | A | 12/1998 | Ishino et al. | |
| 5,851,352 | A | 12/1998 | Vinson et al. | |
| 5,902,454 | A | 5/1999 | Nelson | |
| 5,935,384 | A * | 8/1999 | Taniguchi | 162/172 |
| 5,938,894 | A | 8/1999 | Thebrin et al. | |
| 6,127,593 | A | 10/2000 | Bjorkquist et al. | |
| 6,149,769 | A | 11/2000 | Mohammadi et al. | |
| 6,187,137 | B1 | 2/2001 | Druecke et al. | |
| 6,207,278 | B1 | 3/2001 | Jewell et al. | |
| 6,207,596 | B1 | 3/2001 | Rourke et al. | |
| 6,231,721 | B1 | 5/2001 | Quick et al. | |
| 6,264,791 | B1 | 7/2001 | Sun et al. | |
| 6,365,794 | B1 | 4/2002 | Dabi et al. | |
| 6,379,497 | B1 | 4/2002 | Sandstrom et al. | |
| 6,433,245 | B1 | 8/2002 | Bjorkquist et al. | |
| 6,436,234 | B1 | 8/2002 | Chen et al. | |
| 6,451,718 | B1 | 9/2002 | Yamada et al. | |
| 6,471,824 | B1 | 10/2002 | Jewell | |
| 6,514,382 | B1 * | 2/2003 | Kakiuchi et al. | 162/109 |
| 6,547,927 | B1 | 4/2003 | Takeuchi et al. | |
| 6,547,928 | B2 | 4/2003 | Barnholtz et al. | |
| 6,551,706 | B1 | 4/2003 | Jewell et al. | |
| 6,565,708 | B2 | 5/2003 | Ikeda et al. | |
| 6,572,919 | B2 | 6/2003 | Westland et al. | |
| 6,579,414 | B2 | 6/2003 | Jewell | |
| 6,579,415 | B2 | 6/2003 | Jewell | |
| 6,602,994 | B1 | 8/2003 | Cash et al. | |
| 6,620,865 | B2 | 9/2003 | Westland et al. | |
| 6,630,054 | B1 | 10/2003 | Graef et al. | |
| 6,635,799 | B1 | 10/2003 | Osborn, III et al. | |
| 6,649,025 | B2 | 11/2003 | Mills et al. | |
| 6,669,878 | B2 | 12/2003 | Konishi et al. | |
| 6,703,125 | B2 | 3/2004 | Jewell et al. | |
| 6,712,934 | B2 | 3/2004 | Ahlgren et al. | |
| 6,719,862 | B2 | 4/2004 | Quick et al. | |
| 6,720,057 | B1 | 4/2004 | Neumayr et al. | |
| 6,748,671 | B1 | 6/2004 | Vrbanac et al. | |
| 6,752,944 | B2 | 6/2004 | Jewell et al. | |
| 6,764,988 | B2 | 7/2004 | Koenig et al. | |
| 6,769,199 | B2 | 8/2004 | Vrbanac et al. | |
| 6,782,637 | B2 | 8/2004 | Yancey et al. | |
| 6,821,940 | B2 | 11/2004 | Bullock et al. | |
| 6,862,819 | B2 | 3/2005 | Vrbanac et al. | |
| 6,865,822 | B2 | 3/2005 | Vrbanac et al. | |
| 6,905,748 | B2 | 6/2005 | Sosalla | |
| 6,910,285 | B2 | 6/2005 | Vrbanac et al. | |
| 7,018,508 | B2 | 3/2006 | Yancey et al. | |
| 7,074,301 | B2 | 7/2006 | Hamed et al. | |
| 7,074,845 | B2 | 7/2006 | Laleg | |
| 7,094,317 | B2 | 8/2006 | Lundberg et al. | |
| 7,094,318 | B2 | 8/2006 | Hamed et al. | |
| 7,101,612 | B2 | 9/2006 | Lang et al. | |
| 7,166,190 | B2 | 1/2007 | Graef et al. | |
| 7,169,458 | B2 | 1/2007 | Underhill et al. | |
| 7,241,711 | B2 * | 7/2007 | Takai et al. | 442/414 |
| 7,290,353 | B2 | 11/2007 | Yancey et al. | |
| 7,294,230 | B2 | 11/2007 | Flugge-Berendes et al. | |
| 7,320,740 | B2 | 1/2008 | Hamed et al. | |
| 7,323,438 | B2 | 1/2008 | Hedges et al. | |
| 7,334,347 | B2 | 2/2008 | Mann et al. | |
| 7,378,360 | B2 * | 5/2008 | Clark et al. | 442/414 |
| 7,384,506 | B2 | 6/2008 | Underhill et al. | |
| 7,419,568 | B2 | 9/2008 | Hamed et al. | |
| 7,449,095 | B2 | 11/2008 | Hanatani et al. | |
| 7,585,392 | B2 | 9/2009 | Kokko et al. | |
| 7,615,278 | B2 | 11/2009 | Evers Smith et al. | |
| 7,622,022 | B2 | 11/2009 | Skaggs et al. | |
| 7,625,962 | B2 | 12/2009 | Laleg | |
| 7,655,112 | B2 | 2/2010 | Koslow | |
| 7,741,234 | B2 | 6/2010 | Smith et al. | |
| 7,744,723 | B2 | 6/2010 | Sheehan et al. | |
| 7,745,685 | B2 | 6/2010 | Fell et al. | |
| 7,749,355 | B2 | 7/2010 | Knobloch et al. | |
| 7,749,356 | B2 | 7/2010 | Runge et al. | |
| 7,758,724 | B2 * | 7/2010 | Akai et al. | 162/117 |
| 7,799,167 | B2 * | 9/2010 | Suzuki et al. | 162/117 |
| 7,867,362 | B2 | 1/2011 | Allen et al. | |
| 7,884,037 | B2 | 2/2011 | Sirovatka et al. | |
| 7,927,457 | B2 | 4/2011 | Shannon et al. | |
| 7,951,266 | B2 | 5/2011 | Kokko et al. | |
| 7,972,476 | B2 | 7/2011 | Scherb et al. | |
| 7,972,477 | B2 | 7/2011 | Skaggs et al. | |
| 7,993,490 | B2 | 8/2011 | Runge et al. | |
| 8,030,365 | B2 | 10/2011 | Mohan et al. | |
| 8,034,847 | B2 | 10/2011 | Mohan et al. | |
| RE42,968 | E | 11/2011 | Sheehan et al. | |
| 8,123,906 | B2 | 2/2012 | Soane et al. | |
| 8,138,106 | B2 | 3/2012 | Hamed et al. | |
| 8,157,958 | B2 | 4/2012 | Duarte Villa et al. | |
| 8,182,907 | B2 * | 5/2012 | Barredo et al. | 428/220 |
| 8,211,271 | B2 | 7/2012 | Polat et al. | |
| 8,257,553 | B2 | 9/2012 | Zwick et al. | |
| 8,328,987 | B2 | 12/2012 | Beaupre et al. | |
| 8,349,443 | B2 | 1/2013 | Fugitt et al. | |
| 8,377,526 | B2 | 2/2013 | Mohan et al. | |
| 8,382,947 | B2 | 2/2013 | Skaggs et al. | |
| 8,383,529 | B2 | 2/2013 | Ono et al. | |
| 8,455,077 | B2 | 6/2013 | Vinson et al. | |
| 8,557,269 | B2 | 10/2013 | Kleinwaechter et al. | |
| 8,591,982 | B2 | 11/2013 | Lundberg et al. | |
| 8,603,297 | B2 | 12/2013 | Zwick et al. | |
| 8,647,470 | B2 | 2/2014 | Esser | |
| 8,657,997 | B2 | 2/2014 | Polat et al. | |
| 8,663,425 | B2 | 3/2014 | Noishiki et al. | |
| 8,741,105 | B2 | 6/2014 | Beaupre et al. | |
| 8,758,565 | B2 | 6/2014 | Singh et al. | |
| 8,834,679 | B2 | 9/2014 | Kim et al. | |
| 8,877,678 | B2 | 11/2014 | Koyama et al. | |
| 9,039,651 | B2 * | 5/2015 | Colin et al. | 604/11 |
| 2012/0035526 | A1 * | 2/2012 | Colin et al. | 604/11 |
| 2015/0090414 | A1 * | 4/2015 | Yamada | 162/109 |

FOREIGN PATENT DOCUMENTS

| | | |
|---|---|---|
| JP | S61-033628 | 2/1986 |
| JP | 2-103397 | 8/1990 |
| JP | H02-103397 U | 8/1990 |
| JP | H07-024636 | 3/1995 |
| JP | 2549159 | 8/1996 |
| JP | 2869096 | 12/1998 |
| JP | 2978182 | 9/1999 |
| JP | 2002-529375 | 9/2002 |
| JP | 2004-316024 | 11/2004 |
| JP | 2005-146451 | 6/2005 |
| JP | 3756877 | 1/2006 |
| JP | 2006-150695 | 6/2006 |
| JP | 2006-280616 | 10/2006 |
| JP | 2007-015379 | 1/2007 |
| JP | 2007-061445 A | 3/2007 |
| JP | 2007-075510 | 3/2007 |
| JP | 4052991 | 12/2007 |
| JP | 4097583 | 3/2008 |
| JP | 2008-167784 | 7/2008 |
| JP | 4219267 | 11/2008 |
| JP | 4219323 | 11/2008 |
| JP | 4301996 | 5/2009 |
| JP | 4315893 | 5/2009 |
| JP | 4317434 | 5/2009 |
| JP | 2009-178454 | 8/2009 |
| JP | 4540470 | 7/2010 |

(56) References Cited

FOREIGN PATENT DOCUMENTS

| | | | | | |
|---|---|---|---|---|---|
| JP | 2010-202986 | | | 9/2010 | |
| JP | 4619110 | | | 11/2010 | |
| JP | 4703534 | | | 3/2011 | |
| JP | 2011-074543 | | | 4/2011 | |
| JP | 4713718 | | | 4/2011 | |
| JP | 4733070 | | | 4/2011 | |
| JP | 4753738 | | | 6/2011 | |
| JP | 2011-153387 | | | 8/2011 | |
| JP | 4818063 | | | 9/2011 | |
| JP | 2013249573 | A | * | 12/2013 | |
| JP | EP 2848177 | A1 | * | 3/2015 | ..... B31F 1/07 |
| WO | WO 0027191 | A1 | * | 5/2000 | |
| WO | WO 2012043378 | A1 | * | 4/2012 | |
| WO | WO 2013164913 | A1 | * | 11/2013 | |

* cited by examiner

METHOD FOR PRODUCING WATER-DISINTEGRABLE PAPER

CROSS REFERENCE TO RELATED APPLICATION

This application is a 371 of PCT/JP2013/002911, filed on May 1, 2013, and claims priority to the following Japanese Patent Applications: i) 2012-105118, filed on May 2, 2012; and ii) 2012-223022, filed on Oct. 5, 2012.

STATEMENT REGARDING FEDERALLY SPONSORED RESEARCH OR DEVELOPMENT

N/A

THE NAMES OF THE PARTIES TO A JOINT RESEARCH AGREEMENT

N/A

INCORPORATION-BY-REFERNCE OF MATERIAL SUBMITTED ON A COMPACT DISC OR AS A TEXT FILE VIA THE OFFICE ELECTRONIC FILING SYSTEM (EFS-WEB)

N/A

STATEMENT REGARDING PRIOR DISCLSOURES BY THE INVENTOR OR A JOINT INVENTOR

N/A

BACKGROUND OF THE INVENTION

1. Technical Field

The present invention relates to a method of producing water-disintegrable paper used for toilet cleaning wipes and the like.

2. Background Art

Water-disintegrable paper has been widely used for toilet cleaning wipes. In general, the water-disintegrable paper used for toilet cleaning wipes includes multi-layered sheets of tissue paper adhered to one another through a water-soluble binder and embossed to form high bulky structure in the form of a plurality of projections and depressions. The embossed multi-layered sheets are then impregnated with an aqueous chemical. Toilet cleaning paper towels having such basic structure are described in, for example, JP-U No. H2-103397.

CITATION LIST

Patent Literature

Patent Literature 1: JP-U No. H2-103397

SUMMARY OF INVENTION

Technical Problem

Regarding the toilet cleaning paper towel described in Patent Literature 1, a plurality of sheets of water-soluble paper are layered on top of one another, between each two of which a water-soluble adhesive bonds. Projections and depressions are embedded into the sheets of water-soluble paper on the whole to form a towel element which is then impregnated with a sterilizing solution. However, the process of bonding between paper sheets by means of an adhesive requires time and manpower, increasing manufacturing cost.

Another way for manufacturing toilet cleaning wipes is through processes of layering a plurality of base paper sheets, then spraying a water-soluble binder onto the base paper sheets, then embossing the base paper sheets and then impregnating them with a sterilizing solution. However, if the base paper sheet containing the water-soluble binder is embossed, the base paper sheet adheres to an emboss roller, giving rise to the disadvantage that the embossed base paper sheet does not easily come off the roller.

To prevent the base paper sheet from adhering to the emboss roller, it is required to coat the emboss roller with a separating agent or to coat the base paper sheet with a separating agent, involving time, effort and difficulties.

Further, another water-disintegrable paper is manufactured by supplying a water-soluble binder to the tops of projections produced by the embossing, then mutually aligning and joining the tops of projections of the two layered base paper sheets facing each other through the water-soluble binder, and then impregnating them with an aqueous chemical, which is structured such that the water-soluble binder is contained only inside a paper layer. In the water-disintegrable paper, for example, if it is used as a toilet cleaning wipe, there is a disadvantage that, after a cleaned object (e.g., a toilet bowl) is wiped, paper powder adheres and remains on a dry surface of the cleaned object.

The present invention has been made in the light of the foregoing, and an object of the present invention is to provide a method of producing water-disintegrable paper at low cost of manufacture and in simple manufacturing processes without the disadvantage of adhesion to an emboss apparatus during an emboss process. Another object of the present invention is to provide a method of producing water-disintegrable paper with a minimized likelihood of paper powder adhering and remaining on a dry surface of a cleaned object after the cleaned object is wiped. Still another object of the present invention is to provide a method of manufacturing water-disintegrable paper which is capable of readily manufacturing water-disintegrable paper of high quality as described above.

Solution to Problem

The present invention has construction as described below to address the above technical problems. Accordingly, the present invention provides a method of producing water-disintegrable paper, comprising the steps of: an embossing process of using a base-paper sheet supplied with no water to emboss the base paper sheet in a non-wet state before a water-soluble binder is impregnated in order to form a bulking unit, made up of a plurality of uneven elements, on the base-paper sheet; a binder impregnation process of supplying the water-soluble binder to the base-paper sheet from outside of a face of the base-paper sheet after the embossing process to impregnate the water-soluble binder into the base-paper sheet; a drying process of drying the base-paper sheet after the binder impregnation process; a folding process of folding the base-paper sheet after the drying process; and an aqueous-chemical impregnation process of supplying an aqueous chemical to the base-paper sheet to impregnate the aqueous chemical into the base-paper sheet. A crosslinker causing a cross-linking reaction with the water-soluble binder to form cross-linked structure of the water-soluble binder is preferably impregnated into the base-paper sheet before the folding process. Subsequent to impregnation of the water-soluble binder into the base-paper sheet in the binder impregnation process, the crosslinker causing a cross-linking reaction with the water-soluble binder to form cross-linked structure of the water-soluble binder is preferably impregnated into the base-paper sheet before the drying process.

Advantageous Effects of Invention

In the method of producing the water disintegrable paper according to the present invention, a base-paper sheet which is not supplied with water is used and the base-paper sheet in the non-wet state including no water-soluble binder is embossed to form a bulking unit made up of a plurality of uneven elements. Because of this, a disadvantage of adhesion between the base-paper sheet and an embossing apparatus does not arise in the embossing, with manufacturing being easy. The base-paper sheet, which is not yet cured with the water-soluble binder, is not easily damaged even if the base-paper sheet in the non-wet state is processed, resulting in easy embossing process. Further, the water-soluble binder is impregnated from outside of one side of the base-paper sheet so that the water-soluble binder is impregnated on the surface of the water-disintegrable paper. Therefore, a required strength is imparted to the surface of the water-disintegrable paper. As a result, after the water-disintegrable paper produced according to present invention is used to wipe a cleaned object, paper powder adheres and remains to the dried face, preventing occurrence of paper powder. Further, because the water-soluble binder has the cross-linked structure, the strength of the water disintegrable paper in the wet state is higher, is not torn while in use and provides excellent usability.

In the method of producing water-disintegrable paper according to the present invention, because a base-paper sheet to which water is supplied is used and the base-paper sheet in the non-wet state without the water-soluble binder is embossed, there is a non-likelihood that the base-paper sheet adheres to the embossing apparatus. Accordingly, the embossing apparatus is not required to be coated with a separating agent and the base-paper sheet is not required to be coated with a separating agent, thus simplifying the embossing process and improving manufacturing efficiency. As a result, according to the present invention, the water-disintegrable paper can be easily manufactured and a reduction in manufacturing cost is achieved.

BRIEF SUMMARY OF THE INVENTION

An embodiment of the present invention relates to methods of producing water-disintegrable paper, the methods comprising the steps of:

an embossing process of embossing a base-paper sheet in a non-wet state before a water-soluble binder is impregnated in order to form a bulking unit, made up of a plurality of uneven elements, on the base-paper sheet;

a binder impregnation process of supplying the water-soluble binder to the base-paper sheet from outside of a face of the base-paper sheet after the embossing process to impregnate the water-soluble binder into the base-paper sheet;

a drying process of drying the base-paper sheet after the binder impregnation process;

a folding process of folding the base-paper sheet after the drying process; and an aqueous-chemical impregnation process of supplying an aqueous chemical to the base-paper sheet after the folding process to impregnate the aqueous chemical into the base-paper sheet.

DETAILED DESCRIPTION OF THE INVENTION

Figure 1:
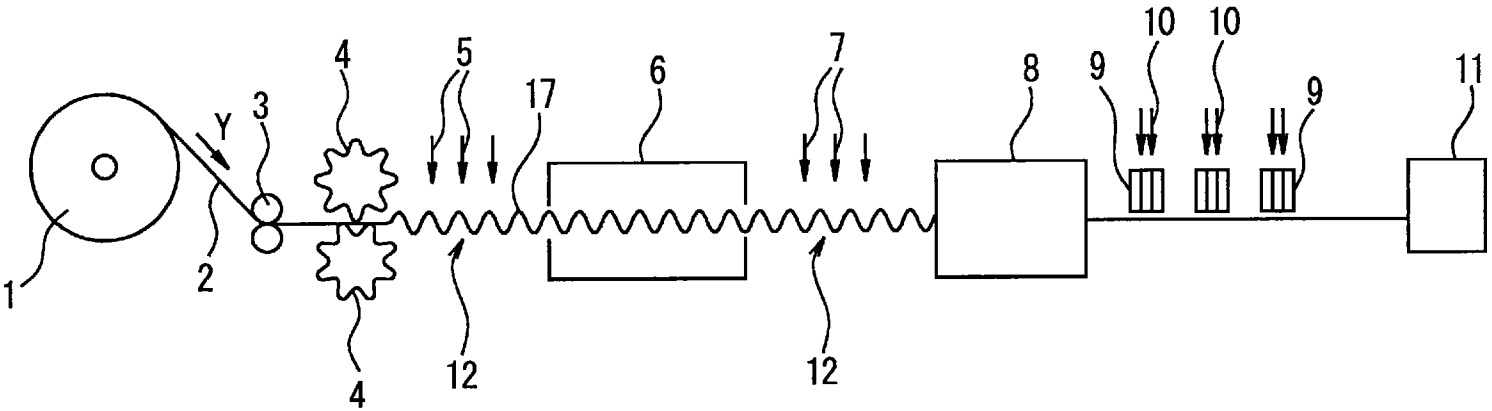
FIG. 1 is a process diagram illustrating an example of a method of manufacturing water-disintegrable paper according to the present invention.

The present invention produces water-disintegrable paper produced from paper materials having water disintegrable properties. In the present invention base paper sheets which are raw-material sheets are processed by a plurality of process steps to produce the water-disintegrable paper, in which various types of raw-material pulp may be employed as materials of the base paper sheet. Examples of the raw-material pulp usable in the present invention include woodpulp, synthetic pulp, recycled fiber, and the like. Further, not only natural fibers such as pulp, but also semi-synthetic fiber such as rayon, and the like may be employed. Further, the present invention may use materials for toilet paper as raw-material pulp. In this case, a mixture of softwood bleached kraft pulp and hardwood bleached kraft pulp is preferably used. Examples of materials for base paper sheets used in the present invention include kenaf, bamboo fiber, straw, cotto, silk thread, and the like.

The embossing process in the present invention causes a lot of projections and depressions to be formed in the base paper sheet to achieve high bulky structure, meaning an increase of the strength and an enhancement of the cleaning function (in particular, wiping function).

As the water-soluble binder used in the present invention, various types of binders can be employed as long as the binder has a predetermined adhesive strength and can apply a predetermined strength to the water-disintegrable paper.

Examples of the water-soluble binder used in the present invention include a polysaccharide derivative, natural polysaccharides, a synthetic polymer, and the like. Examples of the polysaccharide derivative include carboxymethylcellulose, carboxyethylcellulose, carboxymethylated starch or its salt, starches, methylcellulose, ethylcellulose, and the like. Examples of the natural polysaccharides include guar gum, trant gum, xanthan gum, sodium alginate, carrageenan, gum Arabic, gelatin, gasein, and the like. Examples of the synthetic polymer include polyvinyl alcohol, a polyvinyl alcohol derivative, salt of a unsaturated carboxylic acid polymer or copolymer, and the like. Examples of the unsaturated carboxylic acid include an acrylic acid, a methacrylic acid, maleic anhydride, a maleic acid, a fumaric acid, and the like. Using, in particular, sodium salt of carboxymethylcellulose (CMC) of the foregoing is preferable.

The base paper sheet impregnated with the water-soluble binder is further impregnated with an aqueous chemical. The aqueous chemical contains a chemical agent that imparts the cleaning function to the water-disintegrable paper, but can contain another chemical agent formulated for another purpose. As the aqueous chemical, a water-based composition composed of water, a crosslinker and a water-soluble organic solvent is used, which can be mixed with a surfactant, a bactericidal agent, an antiseptic agent, deodorant, a bleaching agent, a chelating agent, perfume, and the like, as necessary.

The crosslinker reacts with the water-soluble binder to form cross-links so that the water-soluble binder has a cross-linked structure, resulting in an enhancement of the physical strength. For the water-soluble binder, if a water-soluble binder having a carboxyl group such as carboxymethylcellulose is used, polyvalent metal ions are preferably used as the crosslinker. For the polyvalent metal ions, metal ions such as zinc, alkaline earth metal, manganese, nickel, cobalt can be used. Specifically, ions of zinc, calcium, barium, cobalt and nickel are preferably used, which are desirable in terms of imparting a sufficient wet strength.

The polyvalent metal ions are used in a form of water-soluble metal salt such as sulfate, chlorides, hydroxides, carbonates, nitrates and/or the like. The crosslinker is one of ingredients constituting the aqueous chemical, but may be used alone, independently of the aqueous chemical as described later.

As water-soluble organic solvent may be used: monovalent alcohol such as ethanol, methanol, isopropylalcohol and the like; glycols such as ethylene glycol, diethylene glycol, polyethylene glycol, propylene glycol, butylene glycol, hexylene glycol and the like; monoether or diether of the glycols and lower alcohol such as methanol, ethanol, propanol, butanol and the like; polyvalent alcohol such as ester of the glycols and lower fatty acid, glycerol, sorbitol; and the like.

Examples of the surfactant mixed into the aqueous chemical as required include an anionic surfactant, a nonionic surfactant, a cationic surfactant, and an amphoteric surfactant. In particular, using a nonionic surfactant such as polyoxyalkylene alkyl ether, alkylglycoside, a sorbitan fatty acid ester and the like is desirable.

Next, an embodiment of a method of manufacturing water-disintegrable paper will be described based on the process step diagram illustrated in FIG. 1. In FIG. 1, reference sign 1 denotes a feeding roll of a long base-paper sheet 2 wound on itself, the base-paper sheet 2 being delivered in the direction of arrow Y by pinch rollers 3. The base-paper sheet 2 to be used may be of single-layer structure including a sheet of tissue paper such as toilet paper or of multi-layer structure including two sheets or more of tissue paper one placed on top of another.

The continuously fed base-paper sheet 2 is delivered to between a pair of upper and lower embossing rollers 4, in which the base-paper sheet 2 is embossed. The embossing rollers 4 have a plurality of projections projecting from the roller peripheral surface to be intended for use in the embossing process, enabling the use of existing well-known embossing rollers. Forming of projection-and-depression shape in the embossing process may be performed either on only one side of the base-paper sheet 2 or on both sides. When embossing is carried out on both sides of the base-paper sheet 2, the embossing rollers used include a pair of upper and lower metal-made rollers having a plurality of projections projecting from the peripheral surfaces of the rollers to be intended for use in the embossing process. When embossing is carried out on one side of the base paper sheet 2, the embossing rollers used include a metal-made roller having a plurality of projections projecting from the peripheral surface to be intended for use in the embossing process, and a rubber-made retard roller which is paired with the metal-made roller on the upper and lower sides.

In the present invention, the base-paper sheet 2 in a non-wet state in which the water-soluble binder is not included is embossed. Herein, the non-wet state does not include the mode in which moisture is applied to the base-paper sheet 2 such as by blowing water on the base-paper sheet 2. In ordinary cases, paper materials include moisture (water content) corresponding to conditions of air temperature and humidity, but the moisture (water content) is not water content positively supplied from outside. Because of this, even if such moisture (water content) is included, this corresponds to the non-wet state according to the present invention. Accordingly, the percentage content of moisture (water content) in the base-paper sheet 2 varies depending on the conditions of air temperature and humidity, and even when the percentage content shows any numeric value, it can be understood that this corresponds to the non-wet state according to the present invention.

As described above, in the present invention, embossing is carried out on the base-paper sheet 2 that is dried in the atmosphere under normal conditions without a supply of water from outside to the base-paper sheet 2 including no water-soluble binder. In the present invention, the base-paper sheet 2 impregnated with the water-soluble binder is not embossed, but the base-paper sheet 2 in the non-wet state before being impregnated with the water-soluble binder is embossed. Because of this, it is unlikely that the base-paper sheet 2 adheres to the embossing rollers 4, eliminating the need for coating the embossing rollers 4 with the separating agent or to coat the base-paper sheet 2 with the separating agent. In the present invention, even if the base-paper sheet 2 is in the non-wet state, the base-paper sheet 2 is easily embossed. The embossing is able to be performed without heating the embossing rollers 4, but the embossing may be performed after the embossing rollers 4 are heated to a predetermined temperature. In the later, a heating temperature for the embossing rollers 4 preferably ranges from 60° C. to 150° C.

Figure 2:
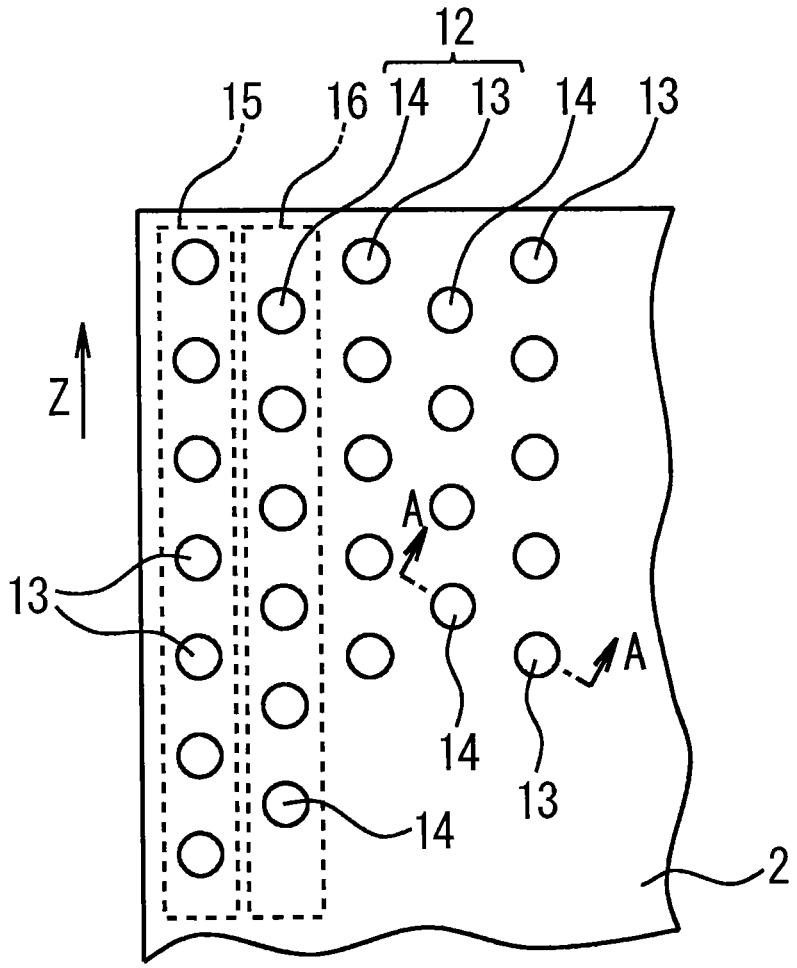
FIG. 2 is a top view partially illustrating an example of water-disintegrable paper produced according to the present invention.
Figure 3:
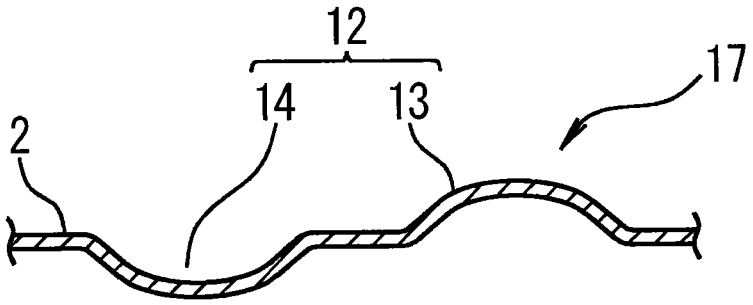
FIG. 3 is a vertical sectional view taken along line A-A in FIG. 2.

Through the embossing, as illustrated in FIG. 2, FIG. 3, a plurality of uneven elements 12 including projections 13 and depressions 14 are formed. The plurality of the uneven elements 12 forms a bulking unit 17. Herein, because in the present invention the embossing is performed on the base-paper sheet 2 in the non-wet state without the water-soluble binder, the ductility is low during the process. For this reason, the base-paper sheet 2 may not respond the load force of the embossing, depending on a emboss depth, so that breaking of part of bonds between fibers may occur. Specifically, a small emboss depth is unlikely to cause such fiber-fiber bond breaking, but a large emboss depth is likely to cause the fiber-fiber bond breaking. For example, when the emboss depth ranges from 1 mm to 5 mm, the fiber-fiber bond breaking easily occurs. It is suggested that the occurrence of fiber-fiber bond breaking is a desirable embodiment as described later, if anything.

In the following process step, a water-soluble binder is applied to the base-paper sheet 2 with the bulking unit 17 made up of a plurality of the uneven elements 12. For the water-soluble binder, for example, carboxymethylcellulose is used. Means for supplying the water-soluble binder are implemented by spraying a water-soluble binder solution 5 from a nozzle of a spraying apparatus onto the surface of the base-paper sheet 2. In this manner, the water-soluble binder is supplied to the base-paper sheet 2 from the outside of the face of the base-paper sheet 2 so that the base-paper sheet 2 is impregnated. In this case, the water-soluble binder solution 5 may be sprayed only onto one side of the base-paper sheet 2 or onto both sides. As the spraying nozzle used for spraying, either of the two nozzles can be used: i) a one-fluid type nozzle from which the water-soluble binder solution 5 pressurized is solely ejected; and ii) a two-fluid type nozzle from which, after compressed air and the water-soluble binder solution 5 are mixed, the pressure of the compressed air is used to eject the water-soluble solution 5 in a fine spray.

The means for supplying the water-soluble binder solution 5 is not limited to the above-mentioned spraying. For example, a technique of dropping the water-soluble binder solution 5 onto the surface of the base-paper sheet 2, a technique of applying coating of the same, and the like may be adopted. The present invention, as described later, has the process step of impregnating the base-paper sheet 2 having the bulking unit 17 with the aqueous chemical, and the process step of impregnating this base-paper sheet 2 with the crosslinker which is an ingredient in the aqueous chemical, so that the base-paper sheet 2 is supplied with the aqueous chemical solution in the aqueous-chemical impregnating process step, and with the crosslinker solution in the crosslinker impregnating process step. In this connection, as means for supplying the aqueous-agent solution and the crosslinker solution, arbitrary means such as a spray technique, a dropping technique, a coating technique or the like can be employed as in the case of the means for supplying the water-soluble binder solution. In the following description, the spray technique is taken as an example of the supplying means.

A preferable amount of supply (amount of addition) of the water-soluble binder to the base-paper sheet 2 ranges from 50 wt % to 100 wt % relative to the weight of the base-paper sheet 2 (50 to 100 wt parts per 100 wt parts of the base-paper sheet). The concentration of the water-soluble binder solution 5 is preferably from 1% to 20%.

By a supply of the aforementioned water-soluble binder, the base-paper sheet 2 is impregnated with the water-soluble binder. Here, as described earlier, when the emboss depth is large in the embossing process, a part of fiber-fiber bond may breaks in the base-paper sheet 2. In this event, even if such partial breaking of the fiber-fiber bond occurs, not only any obstacle to the quality of water-disintegrable paper to be produced is not constituted, but also the following advantages are offered. Specifically, when fiber-fiber bond breaking occurs in the base-paper sheet 2, a spot of the fiber-fiber bond breaking becomes a region that facilitates penetration of the water-soluble binder, increasing the speed of penetration of the water-soluble binder. Accordingly, the speed of penetration of the water-soluble binder is greater than that in the case when fiber-fiber bond breaking does not occur, enabling penetration of the water-soluble binder with efficiency. On the other hand, the water-soluble binder flows into the spot of the fiber-fiber bond breaking. As a result, the fibers are bonded together through the water-soluble binder, making the fiber-fiber bond tight. Specifically, after the water-soluble binder dries to a film, the strength of the binder film is greater than the strength of the fiber, thus achieving an enhancement in the strength of the water-disintegrable paper. Further, after cross-links are formed as described later, the strength of the binder film becomes further greater.

In the process step of impregnation with the water-soluble binder, because the water-soluble binder is supplied from the outside of the face of the base-paper sheet 2, the surface of the base-paper sheet 2 is impregnated with the water-soluble binder. Accordingly, water-disintegrable paper as a final product is in the state of the water-soluble binder impregnated on the surface of the water-disintegrable paper. The water-soluble binder may be penetrated from one face (supply face) of the base-paper sheet 2 toward the other face in the thickness direction (in other words, across the whole layer in the thickness direction) or may be penetrated partway before reaching the other face (in other words, partway in the thickness direction). If the water-soluble binder is penetrated across the whole layer in the thickness direction as in the former case, one face and the other face of the water-disintegrable paper in the thickness direction are in a state of the water-soluble binder permeating their surfaces.

In the above-described binder impregnation process step, when the water-soluble binder is impregnated, the crosslinker which is an ingredient in the aqueous chemical may be impregnated in addition to the water-soluble binder. Specifically, the water-soluble-binder impregnation process step in the present invention includes a process step of impregnating both the water-soluble binder and the crosslinker. A first aspect in the embodiment, initially, the water-soluble binder solution 5 is sprayed onto the base-paper sheet 2 having the bulking unit from the outside of the face of the base-paper sheet 2 so that the base-paper sheet 2 is impregnated with the water-soluble binder. Subsequently, the crosslinker solution is sprayed so that the base-paper sheet 2 is impregnated with the crosslinker. Ina second aspect, initially, the crosslinker solution is sprayed onto the base-paper sheet 2 from the outside of the face of the base-paper sheet 2 so that the base-paper sheet 2 is impregnated with the crosslinker. Subsequently, the water-soluble binder solution 5 is sprayed so that the base-paper sheet 2 is impregnated with the water-soluble binder. Further, in a third aspect, the water-soluble binder solution 5 is sprayed onto the base-paper sheet 2 from the outside of the face of the base-paper sheet 2, and at the same time, the crosslinker solution is sprayed so that the base-paper sheet 2 is impregnated simultaneously with the water-soluble binder and the crosslinker. In each of the embodiments, the crosslinker may be impregnated in the whole amount required to react with the water-soluble binder to form cross links or may be impregnated in a part of the whole amount. At this stage, if the base-paper sheet 2 is impregnated with the whole amount of the crosslinker, in the following aqueous-chemical impregnation process step the base-paper sheet 2 is impregnated with an aqueous chemical without a crosslinker, that is, an aqueous chemical composed of other ingredients other than a crosslinker (hereinafter, the aqueous chemical without the crosslinker is referred to as a "crosslinker-free aqueous chemical"). It should be understood that, in this case, impregnation of the base-paper sheet 2 with the crosslinker-free aqueous chemical is not limited, and the base-paper sheet 2 may be impregnated with the aqueous chemical including the crosslinker. In the above-described binder impregnation process step, if an adequate cross-linking reaction does not occur due to some cause even though the whole amount of crosslinker required for a cross-linking reaction is impregnated into the base-paper sheet 2, the base-paper sheet 2 is impregnated with the aqueous chemical including the crosslinker in the aqueous-chemical impregnation process step to give a satisfactory cross-linking reaction. On the other hand, in the foregoing, if a part of the whole amount of the crosslinker is impregnated into the base-paper sheet 2, the aqueous chemical including the remaining amount of the crosslinker is impregnated into the base-paper sheet 2 in a later process step of impregnating an aqueous chemical.

As described above, if the crosslinker is impregnated in addition to the water-soluble binder in the process step of impregnation with the water-soluble binder, the cross-linking reaction with the water-soluble binder can occur at an earlier stage, speedily imparting predetermined strength to the uneven elements 12 formed through the embossing.

The base-paper sheet 2 impregnated with the water-soluble binder is sent a dryer 6 to be dried. Examples of drying means include electromagnetic wave drying, through-flow drying (hot-air drying), infrared ray drying, hot roller drying, and the like, in which the electromagnetic wave drying is preferable. The electromagnetic wave drying uses electromagnetic wave to effect drying, and an apparatus usable as an electromagnetic wave dryer used in this technique has mechanism and structure similar to those for microwave ovens. The electromagnetic wave drying according to the present invention uses microwave heating to effect drying, which is based on the principle that, upon application of microwaves, an oscillator joining water molecules with polarity absorbs microwave to cause vibrations, rotation and an increase in temperature, the temperature rise evaporating water to effect drying.

The electromagnetic wave drying has an advantage of taking less time to achieve drying. The electromagnetic wave has high penetrating ability, so that the electromagnetic wave is capable of entering inside of the base-paper sheet 2 to heat it, causing the base-paper sheet 2 to be uniformly heated, therefore to be uniformly dried. Further, in the electromagnetic wave drying, because the electromagnetic wave energy is directly loaded without secondary consumption of energy, this makes it possible to produce at least 30% savings in energy as compared with infrared ray heating, resulting in a reduction in the amount of energy consumed, contributing to reduced manufacturing cost. A preferable example of an electromagnetic wave dryer employed in the present invention is one having the ability to dry 1 kg of water in an hour per 1 kW of electric power. As an electromagnetic wave dryer installed in continuous manufacture facilities, a tunnel-type electromagnetic wave dryer capable of continuously passing the base-paper sheet 2 through inside the dryer is preferably used in terms of suitability for continuous production.

Unlike the through-flow drying (hot air drying), in the electromagnetic wave drying, the uneven pattern of the uneven element 12 shaped by the embossing is not likely to be collapsed by wind pressure, and also, unlike the hot roller drying, the uneven pattern is not likely to be collapsed by mechanical pressure.

Further, as compared with the through-flow drying, the infrared ray drying and the hot roller drying, the electromagnetic wave drying has an advantage over drying efficiency so as to require a short time for drying, and therefore offers an advantage in that embossing return, which reduces the difference of embossed height, does not likely occur. Preventing the embossing return occupies an important place in the present invention. Specifically, in the present invention the water-soluble binder is supplied to the base-paper sheet 2 subjected to the embossing process to be impregnated into. For this reason, deformation produced by the embossing is released by the impregnation of the water-soluble binder to undo the uneven pattern of the uneven element 12, which is so-called embossing return. To address this, selection of the drying means is important. If the electromagnetic wave drying is adopted as the drying means, a substantial shortening of the drying time as compared with other drying means can be achieved. This enables the swift removal of water that becomes a cause of the embossing return. As a result, the undoing of the uneven pattern caused by the deformation release is inhibited so as to maintain the shape keeping of the uneven pattern, producing the effect of inhibiting the embossing return. In the electromagnetic wave drying, as described above, the electromagnetic wave passes through the inside of the base-paper sheet 2 to heat it, so that the surface as well as the inside of the base-paper sheet 2 are heated and dried uniformly in a short time, affecting the effect of inhibiting the embossing return.

As means for drying the base-paper sheet 2 impregnated with the water-soluble binder 2, the infrared ray drying can be preferably used. Infrared rays have a wavelength band of 0.75 μm to 1000 μm, which is an electromagnetic wave of a wavelength shorter than that of a microwave. Infrared ray is divided into two, near infrared ray (0.7 μm to 205 μm wavelengths) and far infrared ray (4 μm to 1000 μm wavelengths) according to wavelength. Near infrared ray is not easily absorbed by a substance and is of a low heating efficiency. Therefore, in the present invention far infrared ray which is easily absorbed and is of a high heating efficiency is preferable used. In the present invention, far infrared ray with wavelengths of 4 μm to 50 μm, of far infrared ray with wavelengths of 4 μm to 1000 μm is preferably used. The far infrared ray with wavelengths of 4 μm to 50 μm is of a high absorbance to water. In the case of a substance having a high water content, most of the far infrared ray is absorbed at a relatively shallow depth from the surface to the inside. Because of this, when the far-infrared ray drying is applied to the present invention, an operation advantage of enabling prevention of losing of embossed shape is produced. Specifically, when the base-paper sheet 2 impregnated with the water-soluble binder is radiated with far-infrared ray, most of the far infrared ray is absorbed in an interior region at a relatively shallow depth from the surface of the base-paper sheet 2. Because of this, an area around the surface is speedily heated and dried. Hence, the drying of the embossed surface is developed for a short time. As a result, it is possible to prevent embossed shape from being lost due to contained water. Further, the prevention of losing of embossed shape makes it possible to prevent embossing return which causes a reduction of the difference of embossed height. With such far infrared ray drying, the embossed surface is swiftly dried, making it possible to prevent the embossing return with reliability. Accordingly, there is an advantage of shortening the time required for the drying process step.

The far infrared ray drying is not of a method of heating air to dry a to-be-dried object, and is of a method of using a far-infrared ray heat ray to transfer heat directly to a to-be-dried object for drying, which is the so-called radiant heat drying. Therefore, because the to-be-dried object can be heated with efficiency, the required drying time will be short. It is also possible to use a reflector or the like to reflect the heat ray in a specified direction to be concentrated onto a predetermined position for heat drying. The adoption of such a drying method allows the enhancement of energy efficiency for drying to reduce the cost of the drying process step.

What is required as a far infrared ray dryer includes a heating element generating far infrared rays and even if it has any structure, it can be used. In this case, the far infrared ray dryer is preferably capable of maintaining the temperature of the heating element at 200° C. or higher. By maintaining the temperature of the heating element at 200° C. or higher, efficient generation of far infrared rays is made possible. Power saving operation is enabled by intermittent energization using a thermostat or the like. In the far infrared ray drying, because there is no load applied by a wind pressure as in the through-flow drying (hot air drying) and also no load applied by a mechanical pressure as in the hot roller, there are no possibilities of collapse of the embossed uneven pattern, of deformation of the base-paper sheet 2, and the like.

In regards to the base-paper sheet 2 impregnated with the water-soluble binder being dried by the dryer 6, the present invention is not limited to the case where a single dryer is operated for drying, and a plurality of dryers may be provided and the base-paper sheet 2 may be dried while being fed to each dryer in order. Specifically, for example, the base-paper sheet 2 conveyed by a belt conveyor may be sent to a first dryer to be dried, and then to a second dryer to undergo a second drying process. In this case, the degree of drying can be differed between the first stage drying and the second stage drying. Such multistage drying is particularly useful for the electromagnetic wave drying and the infrared ray drying. The present invention can employ a combination of the electromagnetic wave drying and the infrared ray drying. Specifically, the electromagnetic wave dryer and the infrared ray dryer are each provided. For example, the base-paper sheet 2 may be first sent to the electromagnetic wave dryer to undergo the electromagnetic drying, and then the bas-paper sheet 2 may be sent to the infrared ray dryer to undergo the infrared ray drying, or alternatively, in a retrograde order, the base-paper sheet 2 undergoes first the infrared ray drying and then the electromagnetic drying. Further, the electromagnetic wave drying (or infrared ray drying) of the first stage drying and the infrared ray drying (or electromagnetic wave drying) of the second stage drying may be repeated multiple times in alternate order. In another way, an electromagnetic wave heating mechanism and an infrared ray heating mechanism may be placed in a single dryer. The base-paper sheet 2 may be delivered into the dryer of such structure, in which the base-paper sheet 2 may be heated by electromagnetic waves and concurrently heated by infrared rays for simultaneous process of drying by electromagnetic waves and of drying by infrared rays.

The base-paper sheet 2 dried by the dryer 6 is fed to a folding process step, a cutting process step and an aqueous chemical impregnation process step in order.

Here, as another embodiment according to the present invention, after the water-soluble binder is impregnated into the base-paper sheet 2 having the bulking unit 17, the base-paper sheet 2 impregnated with the water-soluble binder may be dried (with the electromagnetic wave drying, the far infrared ray drying, and/or the like) by the dryer 6 as described above. Then, the base-paper sheet 2 thus dried may be impregnated with a crosslinker. Then, the base-paper sheet 2 impregnated with the crosslinker may be moved through still another dryer to be mildly dried, which may be then delivered to the folding process step. If the base-paper sheet 2 is folded after being completely dried by the dryer 6, cracking possibly occurs in folds. However, according to the embodiment, because the drying immediately preceding the folding process step is not for completely drying, and is for mildly drying (for example, semidry), it is unlikely that cracking occurs in folds when the base-paper sheet 2 is folded.

In the present invention, if drying level provided by the dryer 6 is adjusted, the above-described cracking disadvantage will not be produced. Accordingly, folding the base-paper sheet 2 which has been dried by the dryer 6 is perfectly acceptable. As described earlier, the base-paper sheet 2 thus dried is delivered to the folding process step, the cutting process step and the aqueous chemical impregnation process step in order. In the aqueous chemical impregnation process step, an aqueous chemical composed of a composition solution including water, a crosslinker, a water-soluble organic solution, a surfactant and/or the like is supplied to the folded sheet piece of the base-paper sheet 2 for impregnation. In another embodiment according to the present invention, the crosslinker which is an ingredient in the aqueous chemical may be separated from the other ingredients of the aqueous chemical so that the crosslinker alone may be supplied to the base-paper sheet 2 for impregnation at a stage preceding the folding process step. The embodiment will be described below.

A crosslinker solution 7 is supplied by being sprayed onto the base-paper sheet 2 which has been subjected to the drying process step. For example, a calcium chloride solution, a zinc sulfate solution and the like are used as the crosslinker solution 7.

The amount of supply (amount of addition) of the crosslinker solution 7 to the base-paper sheet 2 is an amount required by metal ions (e.g., zinc ions) to induce a satisfactory cross-link reaction with a carboxyl group in the water-soluble binder impregnated in the base-paper sheet 2. In the present invention, the amount of addition to 1 mol of the carboxyl group is preferably one-third mol or greater, and more preferably, one-half mol or greater.

By spraying the crosslinker solution 7 to the base-paper sheet 2, the crosslinker is impregnated into the base-paper sheet 2 to cause a cross-linking reaction with the water-soluble binder contained in the base-paper sheet 2, resulting in cross-linked structure of the water-soluble binder, thus increasing the strength of the base-paper sheet 2.

Upon completion of the crosslinker impregnation process step, the base-paper sheet 2 is guided into a folder 8 to be folded predetermined times. For example, the base-paper sheet 2 is folded in two along the center. Then, the base-paper sheet 2 is perforated at predetermined intervals, and the 2-folded sheet is further folded in two along the perforation as the center to obtain a 4-folded sheet. Then, the 4-folded sheet is further folded in two along the center to obtain a 8-folded sheet. In another folding method, the base-paper sheet 2 may be folded continuously in an alternating manner and perforated at predetermined intervals such that a bend line is formed continuously along the longitudinal direction.

After completing the folding process step, the base-paper sheet 2 is cut to predetermined dimensions so as to obtain folded-sheet pieces 9. Then, an aqueous chemical solution 10 containing no crosslinker is sprayed to the folded-sheet piece 9, so that the folded-sheet piece 9 is impregnated with the aqueous chemical containing no crosslinker (a crosslinker-free aqueous chemical). A mixture used as a crosslinker-free aqueous chemical includes water, a water-soluble organic solvent, a surfactant, a bactericidal agent, an antiseptic agent, deodorant, perfume, and the like.

The crosslinker-free aqueous chemical is supplied such that it is impregnated in a range from 50 wt % to 200 wt %, preferably, from 130 wt % to 150 wt % relative to the weight of the base-paper sheet 2 in the folded-sheet piece 9 (50 to 200 wt parts, preferably, 130 to 150 wt parts per 100 wt parts of the base-paper sheet), which is desirable for adequately exerting the cleaning function.

In this manner, water-disintegrable paper impregnated with an aqueous chemical is obtained. The water-disintegrable paper in the present invention conceptually means not only that it has a folded shape (folded-sheet piece), but also that it has a flat sheet form in an unfolded state. A plurality of stacks of the folded water-disintegrable paper is packed in a gastight container, thus obtaining a product 11 used for a toilet cleaning wipe, a baby wipe and the like.

The embodiment is not limited to the impregnation of the crosslinker-free aqueous chemical into the folded-sheet piece 9 at the stage before it is packed. The folded-sheet piece 9 may be temporarily put into the gastight container, and then, during this state, the crosslinker-free aqueous chemical solution may be sprayed and supplied through an opening of the container entrance in order that the crosslinker-free aqueous chemical is impregnated into the folded-sheet piece 9.

In the above-described embodiment, the process step of impregnating the aqueous chemical into the base-paper sheet is divided into two, the process step of impregnating the crosslinker which is an ingredient in the aqueous chemical into the base-paper sheet, and the process step of impregnating the aqueous chemical containing no crosslinker into the base-paper sheet. Then, the crosslinker is impregnated before the folding process step. On the other hand, in another embodiment according to the present invention, the crosslinker may not be impregnated at a stage before the folding process step, and the crosslinker may be impregnated after the folding process step and the cutting process step following the folding process step. In this case, the aqueous chemical solution containing the crosslinker is sprayed to the folded-sheet piece 9 in order that the aqueous chemical containing the crosslinker is impregnated into the folded-sheet piece 9.

In the embodiment in which the folded-sheet piece 9 is impregnated with the aqueous chemical containing the crosslinker, the amount of supply of the crosslinker to the folded-sheet piece 9 and the amount of supply of composition components of the aqueous chemical except components of the crosslinker agent are preferably similar to the case of the embodiment (the impregnation of the crosslinker before the folding process step and the impregnation of the crosslinker-free aqueous chemical after the folding process step and the cutting process step).

In the present invention, of the two embodiments, the embodiment in which the crosslinker is impregnated into the base-paper sheet 2 at a stage before the folding process step is preferable. The reasons are as follows.

Specifically, in the embodiment in which the aqueous chemical containing the crosslinker is impregnated into the folded-sheet piece 9 after the folding process step and the cutting process step, a plurality of folded-sheet pieces 9 are arranged in upright position. In this state, the aqueous chemical solution is sprayed from above to be supplied to the folded-sheet pieces 9. Because of this, the aqueous chemical supplied by spraying passes through a peripheral portion of the folded-sheet piece 9 to be impregnated with the impregnation distribution being gradually spread out toward a central portion. Because a difference is produced in progress of impregnation as described above, a cross-linking reaction with the water-soluble binder occurs initially from the peripheral portion so that the crosslinker which is an ingredient of the aqueous chemical is consumed by a cross-linking reaction occurring in the peripheral portion on a priority basis. For this reason, in the process of impregnation of the aqueous chemical toward the central portion, crosslinker concentrations become gradually low. From this fact, a phenomenon in which crosslinker concentrations are lower and the degree of crosslinking is lower in the central portion occurs. As a result, the degree of crosslinking of the water-soluble binder in the central portion is smaller than that in the peripheral portion, leading to variations of strength in which a physical strength in the central portion is smaller than that in the peripheral portion.

In contrast to this, in the embodiment in which the crosslinker solution 7 is sprayed to the base-paper sheet 2 for impregnation before the folding process step, the crosslinker solution 7 is supplied by being sprayed from above toward the surface of the base-paper sheet 2. Therefore, the crosslinker solution 7 is uniformly sprayed onto the sheet face, so that the crosslinker is uniformly impregnated in the thickness direction of the base-paper sheet 2. As a result, a difference in the degree of crosslinking of the water-soluble binder between the peripheral portion and the central portion as described above, so-called variations of crosslinking, is not produced. The degree of crosslinking of the water-soluble binder is constant over the entire base-paper sheet 2. This brings about an advantage that uniform physical strength is provided over the entire base-paper sheet 2. Thus, the folded-sheet piece 9 obtained by folding the base-paper sheet 2 has also a uniform physical strength. For this reason, the embodiment in which the crosslinker is impregnated before the folding process step is preferable.

In the case when the crosslinker is not impregnated into the base-paper sheet 2 before the folding process step and the aqueous chemical containing the crosslinker is impregnated into the folded-sheet piece 9 after the folding process step and the cutting process step, the adoption of the supply method is preferable, in which the aqueous chemical solution containing the crosslinker is sprayed from above onto the folded-sheet piece 9 placed in the upright position, then the upright position is turned upside down so that the folded-sheet pieces 9 are arranged in the inverted position, and then, in this state, the aqueous chemical solution is sprayed from above again. In another supply method, the aqueous chemical solution may be sprayed to the folded-sheet piece 9 in the upright position from the side-to-side directions. With these supply methods, the aqueous chemical containing the crosslinker can be uniformly impregnated, thus preventing variations in crosslinking. For impregnation of the aqueous chemical containing the crosslinker after the folding process step and the cutting process step, the aqueous chemical is preferably supplied to be impregnated in a range from 50 wt % to 200 wt %, preferably, from 130 wt % to 150 wt % relative to the weight of the base-paper sheet 2 in the folded-sheet piece 9 (50 to 200 wt parts, preferably, 130 to 150 wt parts per 100 wt parts of the base-paper sheet).

A preferable embodiment of the present invention is the embodiment as described above in which the process step of impregnating the aqueous chemical into the base-paper sheet is divided into two, the process step of impregnating the crosslinker which is an ingredient in the aqueous chemical into the base-paper sheet before the folding process step (hereinafter referred to as the "A process step"), and the process step of impregnating the aqueous chemical containing ingredient composition excepting crosslinker ingredients (crosslinker-free aqueous chemical) to the base-paper sheet after the folding process step and the cutting process step. In the embodiment, for the supply of the crosslinker solution to the base-paper sheet before the folding process step, a mixed solution made by mixing the crosslinker solution with the aqueous chemical solution containing ingredient composition excepting crosslinker ingredients (crosslinker-free aqueous chemical solution) may be supplied to the base-paper sheet. In this case, as the amount of crosslinker in the crosslinker solution, a part of the whole amount of crosslinker used in the A process step (for example, 80% of the whole amount) is used. On the other hand, as the amount of crosslinker-free aqueous chemical in the crosslinker-free aqueous chemical solution, a part of the whole amount of aqueous chemical used in the B process step (for example, 20% of the whole amount) is used. Then, in the B process step after the folding process step and the cutting process step, for the supply of the crosslinker-free aqueous chemical solution to the base-paper sheet, a mixed solution made by mixing the crosslinker-free aqueous chemical solution with the crosslinker solution is supplied to the base-paper sheet. In this case, as the amount of crosslinker-free aqueous chemical in the crosslinker-free aqueous chemical solution, a remaining amount of the whole amount of crosslinker-free aqueous chemical used in the B process step (for example, 80% of the whole amount) is used. On the other hand, as the amount of crosslinker in the crosslinker solution, a remaining amount of the whole amount of crosslinker used in the A process step (for example, 20% of the whole amount) is used. The above case is not limited to the supply of the mixed solution of the crosslinker solution and the crosslinker-free aqueous chemical solution to the base-paper sheet in the A process step and the B process step. Without mixing the crosslinker solution and the crosslinker-free aqueous chemical solution, the supply of the crosslinker solution to the base-paper sheet and the supply of the crosslinker-free aqueous chemical solution to the base-paper sheet may be independently performed.

In the aforementioned embodiment, in the A process step, the whole amount of the crosslinker (100%) is used and as the amount of the crosslinker-free aqueous chemical, a part of the whole amount of the crosslinker-free aqueous chemical used in the B process step (for example, 20% of the whole amount) is used so that a mixed solution of the crosslinker solution and the crosslinker-free aqueous chemical solution is supplied to the base-paper sheet. On the other hand, in the B process step, as the amount of the crosslinker-free aqueous chemical, a remaining amount of the whole amount of the crosslinker-free aqueous chemical used in the B process step (for example, 80% of the whole amount) is used sot that the crosslinker-free aqueous chemical solution may be supplied to the base-paper sheet. Further, in the A process step, as the amount of the crosslinker, a part of the whole amount of the crosslinker used in the A process step (for example, 80% of the whole amount) is used so that the crosslinker solution is supplied to the base-paper sheet. Then, in the B process step, the whole amount of the crosslinker-free aqueous chemical (100%) is used, and a remaining amount of the whole amount of the crosslinker used in the A process step (for example, 20% of the whole amount) is used so that a mixed solution of the crosslinker solution and the crosslinker-free aqueous chemical solution may be supplied to the base-paper sheet.

In the present invention, in the process step of impregnating the water-soluble binder into the base-paper sheet 2, the base-paper sheet 2 may be impregnated with the crosslinker before the process step of drying the base-paper sheet 2 subsequent to the impregnation of the water-soluble binder into the base-paper sheet 2. The water-soluble binder speedily enters the interior of the base-paper sheet 2 because the water-soluble binder is sprayed to the base-paper sheet 2 which has been embossed in its non-wet state in which the water-soluble binder is not impregnated with no water-soluble binder, but the crosslinker sprayed subsequent to this is not easily impregnated into the inner layer of the base-paper sheet 2 in the wet state, so that a concentration gradient is produced in the thickness direction of the base-paper sheet 2 so as to cause the crosslinker to remain in a relatively high concentration in the vicinity of the surface. Accordingly, if the crosslinker is supplied to the base-paper sheet 2 prior to the drying process step, a crosslinking reaction occurs at higher densities than that on the surface layer of the base-paper sheet 2. As a result, it is possible to selectively increase the strength on the surface layer of the base-paper sheet 2, making it possible to effectively prevent paper powder when the produced water-disintegrable paper is used.

The water-disintegrable paper manufactured in this manner has the uneven element 12 including a plurality of the projections 13 and depressions 14 formed uniformly throughout the entire surface by embossing as illustrated in FIG. 2 and FIG. 3. The uneven elements 12 form the bulking unit 17. As result, the water disintegrable paper is structured as high bulky paper. A plurality of projections 13 is linearly aligned along the fed direction (Z direction in FIG. 2) of the base-paper sheet 2 in the manufacturing process so as to form projection lines 15. Likewise, a plurality of depressions 14 is linearly aligned along the Z direction to form depression lines 16. The projection lines 15 and the depression lines 16 are structured in a pattern in which they are repeatedly placed in a staggered format in a direction at right angles to the Z direction.

In the water disintegrable paper produced according to the present invention, the shape of the projection 13 and the depression 14 in the uneven element 12 is arbitrarily, which is not limited to a circular shape as illustrated in FIG. 2 and may be an oval shape, a triangular shape, a rectangular shape, a diamond shape or the like or may be figure, decorative pattern such as an amorphous shape, flower pattern or the like.

The water-disintegrable paper produced according to the present invention contains a water-soluble binder having the cross-linked structure. If the electromagnetic wave drying is performed in the manufacturing process, the water-disintegrable paper results in form containing the water-soluble binder subjected to the electromagnetic-wave drying process. If the far infrared ray drying is performed in the manufacturing process, the water-disintegrable paper results in form containing the water-soluble binder subjected to the far infrared ray drying process. In the present invention, because the water-soluble binder is supplied from the outward face side of the base-paper sheet, the impregnation region of the water-soluble binder includes the surface of the water-disintegrable paper. Therefore, the surface of the water-disintegrable paper is impregnated with the water-soluble binder, thereby imparting a required strength to the surface of the water-disintegrable paper. Because of this, if the cleaned object is wiped using the water-disintegrable paper produced according to the present invention, it is unlikely that, after wiping, paper powder adheres and remains on the dried face of the cleaned object, preventing occurrence of paper powder.

The water-disintegrable paper produced according to the present invention is able to be used for cleaning goods for cleaning a toilet bowl in a toilet and its surrounding, baby-wipe goods, and the like. The water-disintegrable paper produced according to the present invention has a predetermined strength in its wet state, which is not torn while in use, provides excellent usability, swiftly dissolves in water by flushing it down a toilet after use, and is unlikely to cause clogging of a sewer pipe. The water-disintegrable paper produced according to the present invention is superior to both strength and water disintegrating properties as described above.

EXAMPLES

Example 1

As a base-paper sheet, toilet paper materials composed of softwood bleached kraft pulp and hardwood bleached kraft pulp is used. Two lengths of toilet paper each having basis weight 25 g/m$^2$ made of the materials are placed one on top of another and then wound on itself in a roll form.

The base-paper sheet is fed from the roll. The base-paper sheet in the non-wet state without the water-soluble binder impregnated passes through between a pair to upper and lower embossing rollers to be embossed to an emboss depth of 3 mm in order to form a bulking unit including a plurality of uneven elements on both sides of the base-paper sheet.

To the embossed base-paper sheet, a solution of sodium salt of carboxymethylcellulose (CMC) as a water-soluble binder is sprayed from the outside of one face of the base-paper sheet so that the base-paper sheet is impregnated with the CMC solution. The CMC solution at a 10% concentration is used and the amount of spray is determined such that the CMC content becomes 60 wt % relative to the weight of the base-paper sheet.

The base-paper sheet impregnated with CMC is dried through the far infrared ray dryer and then moves through the folder to obtain a perforated 8-folded sheet, which is then cut to predetermined dimensions to obtain folded-sheet pieces.

The aqueous chemical solution including the crosslinker is sprayed to the folded-sheet piece to be impregnated into the folded-sheet piece. One used as the aqueous chemical solution is obtained by dissolving, in an ethanol/water mixed solution at a ratio between ethanol and water standing at 50:50 (weight ratio), calcium chloride to a 1.0% concentration, and polyoxyethylene lauryl ether (surfactant) to a 0.3% concentration. The amount of spray of the aqueous chemical solution is determined such that the aqueous chemical content becomes 140 wt % relative to the weight of the base-paper sheet. Thus, a toilet cleaning wipe is obtained as a water-disintegrable paper cleaning item.

Example 2

The CMC solution is sprayed to be impregnated into the base-paper sheet embossed as in the case of example 1. Subsequently, the crosslinker solution is sprayed to be impregnated into the base-paper sheet. One used as the crosslinker solution is obtained by dissolving, in an ethanol/water mixed solution at a ratio between ethanol and water standing at 50:50 (weight ratio), calcium chloride to a 1.0% concentration. The sum total of the amount of crosslinker supplied to the base-paper sheet in the crosslinker impregnation process step before the drying process step, and the amount of crosslinker contained in the aqueous chemical used in the aqueous chemical impregnation process step after the drying process step is determined such that the crosslinker solution content becomes 150 wt % relative to the weight of the base-paper sheet. The amount of crosslinker supplied to the base-paper sheet in the crosslinker impregnation process step before the drying process step, that is, the amount of spray of the crosslinker solution is determined to be 60% of the sum total amount of the crosslinker.

Then, as in the case of example 1, the base-paper sheet is subjected to the drying process step, the folding process step and the cutting process step to obtain a folded-sheet piece. The aqueous chemical solution containing the crosslinker is sprayed to be impregnated into the folded-sheet piece. The same aqueous chemical solution as that used in example 1 is used. The amount of spray of the aqueous chemical solution is determined such that the aqueous chemical content becomes 140 wt % relative to the weight of the base-paper sheet. The amount of crosslinker contained in the aqueous chemical solution is determined to be 40% of the sum total amount of the crosslinker.

Thus, a toilet cleaning wipe is obtained as a water-disintegrable paper cleaning item.

Example 3

The CMC solution is sprayed to be impregnated into the base-paper sheet embossed as in the case of example 1. After the base-paper sheet is dried by the far infrared ray dryer, the crosslinker solution is sprayed to be impregnated into the base-paper sheet. The same crosslinker solution as that in example 2 is used. The amount of spray of the crosslinker solution is determined such that the crosslinker solution content becomes 150 wt % relative to the weight of the base-paper sheet.

Then, as in the case of example 1, the base-paper sheet is subjected to the folding process step and the cutting process step to obtain a folded-sheet piece. The aqueous chemical solution containing no crosslinker (crosslinker-free aqueous chemical solution) is sprayed to the folded-sheet piece so that the crosslinker-free aqueous chemical solution is impregnated into the folded-sheet piece. One used as the crosslinker-free aqueous chemical solution is obtained by dissolving, in an ethanol/water mixed solution at a ratio between ethanol and water standing at 50:50 (weight ratio), polyoxyethylene lauryl ether (surfactant) to a 0.3% concentration. The amount of spray of the crosslinker-free aqueous chemical solution is determined such that the crosslinker-free aqueous chemical content becomes 130 wt % relative to the weight of the base-paper sheet. Thus, a toilet cleaning wipe is obtained as a water-disintegrable paper cleaning item.

Industrial Applicability

The present invention is capable of facilitating manufacturing of water-disintegrable paper to allow manufacturing of products such as toilet cleaning wipes and the like of high quality at low cost.

REFERENCE SIGNS LIST

2 Base-paper sheet
5 Water-soluble binder solution
6 Dryer
8 Folder
10 Aqueous chemical solution
12 Uneven element
17 Bulking unit

The invention claimed is:

1. A method of producing water-disintegrable paper, comprising the steps of:

an embossing process of using a base-paper supplied with no water to emboss the base-paper sheet in a non-wet state before a water-soluble binder is impregnated in order to form a bulking unit, made up of a plurality of uneven elements, on the base-paper sheet;

a binder impregnation process of supplying the water-soluble binder to the base-paper sheet from outside of a face of the base-paper sheet after the embossing process to impregnate the water-soluble binder into the base-paper sheet;

a drying process of drying the base-paper sheet after the binder impregnation process;

a folding process of folding the base-paper sheet after the drying process; and an aqueous-chemical impregnation process of supplying an aqueous chemical to the base-paper sheet after the folding process to impregnate the aqueous chemical into the base-paper sheet.

2. The method of producing the water-disintegrable paper according to claim 1, wherein a crosslinker causing a cross-linking reaction with the water-soluble binder to form cross-linked structure of the water-soluble binder is impregnated into the base-paper sheet before the folding process.

3. The method of producing the water-disintegrable paper according to claim 2, wherein, subsequent to impregnation of the water-soluble binder into the base-paper sheet in the binder impregnation process, the crosslinker causing a cross-linking reaction with the water-soluble binder to form cross-linked structure of the water-soluble binder is impregnated into the base-paper sheet before the drying process.

4. The method of producing the water-disintegrable paper according to claim 1, wherein, subsequent to impregnation of the water-soluble binder into the base-paper sheet in the binder impregnation process, a crosslinker causing a cross-linking reaction with the water-soluble binder to form cross-linked structure of the water-soluble binder is impregnated into the base-paper sheet before the drying process.

* * * * *